US006651542B2

(12) United States Patent
Danner et al.

(10) Patent No.: US 6,651,542 B2
(45) Date of Patent: Nov. 25, 2003

(54) ACTUATOR ASSEMBLY

(75) Inventors: Dale R. Danner, Eastview, KY (US); David O. Matteson, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 10/078,200

(22) Filed: Feb. 19, 2002

(65) Prior Publication Data

US 2002/0078615 A1 Jun. 27, 2002

Related U.S. Application Data

(62) Division of application No. 09/711,494, filed on Nov. 13, 2000.

(51) Int. Cl.[7] ..... F41A 19/69
(52) U.S. Cl. ..... 89/28.05; 89/135
(58) Field of Search ..... 89/28.05, 135; 42/84

(56) References Cited

U.S. PATENT DOCUMENTS

| | | | | |
|---|---|---|---|---|
| 337,872 | A | 5/1886 | Russell | |
| 2,780,882 | A | 2/1957 | Temple | 42/84 |
| 2,957,391 | A | 10/1960 | Lovercheck | 89/28 |
| 3,250,034 | A | 5/1966 | Simmons | 42/84 |
| 3,255,547 | A | 6/1966 | Gregory, Jr. | 42/84 |
| 3,299,812 | A | 1/1967 | Suh et al. | 102/39 |
| 3,495,349 | A | 2/1970 | Thompson | 42/84 |
| 3,613,282 | A | 10/1971 | Ramsay | 42/84 |
| 3,650,174 | A | 3/1972 | Nelsen | 89/28 |
| 3,736,837 | A | 6/1973 | Kaprelian et al. | 89/28 |
| 3,814,017 | A | 6/1974 | Backstein et al. | 102/70.2 |
| 4,134,223 | A | 1/1979 | Hillenbrant et al. | 42/84 |
| 4,275,521 | A | 6/1981 | Gerstenberger et al. | 42/84 |
| 4,324,060 | A | 4/1982 | Lawrence | 42/84 |
| 4,329,803 | A | 5/1982 | Johnson et al. | 42/84 |
| 4,332,098 | A | 6/1982 | Estenevy | 42/84 |
| 4,347,679 | A | 9/1982 | Grunig et al. | 42/84 |
| 4,510,844 | A | 4/1985 | Fritz et al. | 89/135 |
| 4,563,828 | A | 1/1986 | Kriegeskorte | 42/84 |
| 4,727,670 | A | 3/1988 | Krouse | 43/69.01 |
| 4,793,085 | A | 12/1988 | Surawski et al. | 42/84 |
| 4,825,765 | A | 5/1989 | Ochi et al. | 102/206 |
| 4,960,033 | A | 10/1990 | Quantz | 89/28.05 |
| 4,970,819 | A | 11/1990 | Mayhak | 42/70.01 |
| 5,031,536 | A | 7/1991 | Barker et al. | 102/202.5 |
| 5,062,232 | A | 11/1991 | Eppler | 42/70.11 |
| 5,083,392 | A | 1/1992 | Bookstaber | 42/84 |
| 5,138,946 | A | 8/1992 | Soltz et al. | 102/201 |
| 5,204,490 | A | 4/1993 | Soltz et al. | 102/201 |
| 5,206,455 | A | 4/1993 | Williams et al. | 102/201 |

(List continued on next page.)

FOREIGN PATENT DOCUMENTS

| | | | | |
|---|---|---|---|---|
| DE | 23 37 738 | | 8/1978 | |
| DE | 28 37 738 | | 8/1978 | |
| DE | 35 16202 | A1 | 6/1986 | |
| DE | 43 02 009 | A1 * | 7/1994 | 89/135 |
| FR | 958.473 | * | 3/1950 | 89/28.05 |
| SU | 1830443 | A1 * | 7/1993 | 89/28.05 |

OTHER PUBLICATIONS

English abstract of SU 1830443 A1.*

English abstract of DE 43 02 009 A1.*

*Primary Examiner*—Stephen M. Johnson
(74) *Attorney, Agent, or Firm*—Womble Carlyle Sandridge & Rice, PLLC

(57) ABSTRACT

A trigger actuator having a substantially unitary structure with a measuring device mounted thereon to detect the application of force to the trigger. In response, the measuring device generates a trigger signal. A compensating system detects additional or undesirable effects applied to the actuator and generates a compensating signal to modify and compensate for such effects on the actuator.

15 Claims, 12 Drawing Sheets

U.S. PATENT DOCUMENTS

| | | | | |
|---|---|---|---|---|
| 5,272,828 | A | 12/1993 | Petrick et al. | 42/84 |
| 5,301,448 | A | 4/1994 | Petrick et al. | 42/70.01 |
| 5,303,495 | A | 4/1994 | Harthcock | 42/84 |
| 5,329,840 | A | 7/1994 | Corney | 89/135 |
| 5,461,812 | A | 10/1995 | Bennett | 42/70.11 |
| 5,485,786 | A | 1/1996 | Hease et al. | 102/202.5 |
| 5,546,690 | A | 8/1996 | Ciluffo | 42/70.11 |
| 5,625,972 | A | 5/1997 | King et al. | 42/84 |
| 5,755,056 | A | 5/1998 | Danner et al. | 42/84 |
| 5,799,433 | A | 9/1998 | Danner et al. | 42/1.05 |
| 6,260,300 | B1 | 7/2001 | Klebes et al. | 42/70.11 |
| 6,286,241 | B1 | 9/2001 | Constant et al. | 42/84 |
| 6,286,242 | B1 | 9/2001 | Klebes | 42/84 |
| 6,321,478 | B1 | 11/2001 | Klebes | 42/84 |

* cited by examiner

ACTUATOR ASSEMBLY

CROSS REFERENCE TO RELATED APPLICATIONS

The present application is a divisional application of U.S. patent application Ser. No. 09/711,494 filed Nov. 13, 2000.

FIELD OF THE INVENTION

The present invention generally relates to actuators, and in particular relates to a trigger actuator assembly for a firearm or similar hand-operated device for controlling the initiation of a firing sequence or operation of the firearm or other hand-operated device.

BACKGROUND OF THE INVENTION

Actuator systems for most firearms and other hand-actuated, similar devices traditionally have been substantially mechanical systems, relying on levers, cam surfaces, and springs set into motion by the squeezing of a trigger to activate a switch or initiate the operation of the device. For example, with most conventional firearms, the squeezing of the trigger releases a firing pin to strike and thus set off a primer charge such as for a round of ammunition. Being primarily mechanically based, such systems generally require close manufacturing tolerances and further inherently suffer from limitations in control of the actuation or operation of the device or other problems such as discontinuities in the trigger pull force. In addition, in most conventional mechanically activated firearms, there is often a shifting and/or an audible knock or click as the sear is disengaged from the firing pin to enable the firing pin to be moved into contact with the primer. Further, over time, the use and motion of such mechanical assemblies tends to cause wear on the mechanical parts that can result in further discontinuities in the operation of the trigger or actuator assembly. The fact that most mechanical triggers require considerable trigger engagement, trigger movement from the starting point to the point of activation, as well as the inherent inconsistencies and discontinuities can significantly affect the operation of the device, such as diminishing or otherwise affecting the accuracy of a firearm by causing the shooter to anticipate the shot and shift or move the firearm during the trigger pull.

Electrical and electro-mechanical actuator assemblies or mechanisms using electromagnets, solenoids and/or piezoelectric elements have been proposed, including for use in firearm trigger assemblies, wherein an electromechanical switch or other electric element is engaged by the movement of the trigger to cause the release of the firing pin for engagement and setting off of the round of ammunition. Such systems, however, still generally have a significant, mechanical component, as they typically still include a series of mechanical linkages and elements that move and engage an electronic switch for activation of the device. Thus, these electrically actuated systems can still suffer from the discontinuities and other problems inherent in mechanical actuator assemblies.

Therefore, it can be seen that a need exists for an actuator assembly with a reduced number or substantially no moving parts, and which thus substantially eliminates the problems inherent in most mechanical actuator assemblies.

SUMMARY OF THE INVENTION

The present invention relates to a trigger actuator for initiating and controlling the operation of a hand-actuated/ operated device, such as for controlling operation of a variable speed drill, saw or similar hand-activated tool, and in particular for initiating or setting off a primer charge for a round of ammunition in a firearm or a shot charge or power load for driving a fastener. The actuator generally includes a trigger assembly having a body and trigger that is formed with and projects from the body so that the trigger assembly has a substantially unitary or one-piece construction so as to require substantially no movement thereof for actuation, and a controller that typically comprises a microprocessor.

In an initial embodiment, a first or trigger measuring device, such as a strain gauge, load cell, transducer, force-sensor, force sensing resistor, conductive rubber, piezoelectric sensor, piezo-resistive film or similar type of sensing element is mounted adjacent the trigger to detect and measure a force applied to the trigger by the user. Typically, the first measuring device will be positioned along the trigger or along a cantilever or extension section formed between the trigger and body of the trigger assembly, or at a desired position along the body. The measuring device detects the application of force to the trigger and generates a trigger signal in response. A cavity, notch, bump, or other sensitivity increasing feature also can be formed in the body, trigger, or cantilever for increasing the sensitivity of the measuring device to detect a force applied to the trigger to ensure that the application of force to the trigger will be detected by the trigger-measuring device. The trigger signal from the trigger measuring device is received by a control system which in turn initiates the operation of the device to which the actuator assembly is mounted.

In a further embodiment, a compensating system is provided for compensating for variances or errors in the trigger signal provided by the trigger-measuring device. The compensating system can include both mechanical and electrical components. For example, in one embodiment of the present invention, a compensating mass can be formed with the body of the trigger assembly, supported by a compensating cantilever. In such an embodiment, a second or compensating measuring device, such as a strain gauge or similar sensing element will be mounted to the compensating cantilever or mass. If the device or system in which the actuator is used is inadvertently jarred or receives a shock or other force, such as from being dropped, as opposed to the application of force to the trigger alone (i.e., squeezing of the trigger), the compensating measuring device for the compensating system will record and generate a compensating signal similar to the trigger signal so as to cancel an undesired trigger signal. Further, the measuring devices can be configured opposite in polarity to provide the additional feature of self-compensating for variations in the measurement device itself, such as, for example, by canceling any errors induced through variations in operating temperature.

The compensating system also can include an amplifier that combines and potentially modifies the trigger and compensating signals, and/or a filter system employing low pass, high pass or band pass filters for monitoring the rate of change in the trigger signal. Thus, if the trigger signal rate of change is provided at a rate that is too fast or too slow, so as to fall outside of a predetermined operating range, as would be the case if the trigger were jarred or subjected to extreme temperatures, the trigger signal will be blocked or filtered from being transmitted to the actuator control system.

The control system of the actuator assembly generally includes a controller for processing inputs from the trigger assembly and compensating system, which generally is a microprocessor. The controller can be programmed with pre-determined operating ranges for the rate of change of the trigger signal and can include the filter and/or a comparator system. The controller receives the trigger signal and any input received from the compensating system and, in response, initiates an operational sequence. For example, the comparator system will receive and compare the trigger signal to a pre-determined or pre-programmed reference such as a programmed voltage reference. The voltage reference typically is variable and can be set as a predetermined value or range of values such that if the trigger signal falls outside of this range, the trigger signal is blocked, and the variability of the voltage reference further enables the adjustment or setting of a desired trigger pull that is consistently required for initiating an operational sequence.

The controller can be a separate processor that processes and controls the inputs from the trigger assembly and compensating system of the present invention, or can be the electronic controller for the device, such as an electronic firearm as disclosed in U.S. Pat. No. 5,755,056, for operation with both percussion actuated primers or ammunition and with electrically actuated ammunition primers. Further, the controller may directly incorporate the compensation system directly via digital signal processing (DSP). Those skilled in the art will understand that low pass, band pass, high pass, and notch filtering techniques can be performed either via external analog components (resistors, capacitors, op amps, etc.) or by DSP Z Transform processing techniques.

Various objects, features and advantages of the present invention will become apparent to those skilled in the art upon a review of the following specification, when taken in conjunction with the accompanying drawings.

DETAILED DESCRIPTION

Referring now in greater detail to the drawings in which like numerals indicate like parts throughout the several views, the present invention relates to an actuator assembly 10 for use in initiating and controlling the operational sequence of a hand-actuated or hand-operated device, and in particular for initiating or setting off a primer charge for a round of ammunition in a firearm or a shot-charge or power-load for driving a fastener. For purposes of illustration only, the present invention will be described below with respect to an example embodiment of the use of the actuator assembly 10 in a firearm "F", being illustrated in FIG. 1 as a rifle, although it will be understood that the present invention can also be used in various other types of firearms such as handguns, shotguns and other long guns. It further will be understood by those skilled in the art that the present invention is fully applicable for initiating and controlling the operation of a variety of hand-actuated or hand-operated devices, such as for controlling the operation of a variable speed drill, saw or similar hand-activated tool, in addition to being used in various types of firearms. The application of the present invention therefore should not be limited solely to use in firearms.

Figure 1:
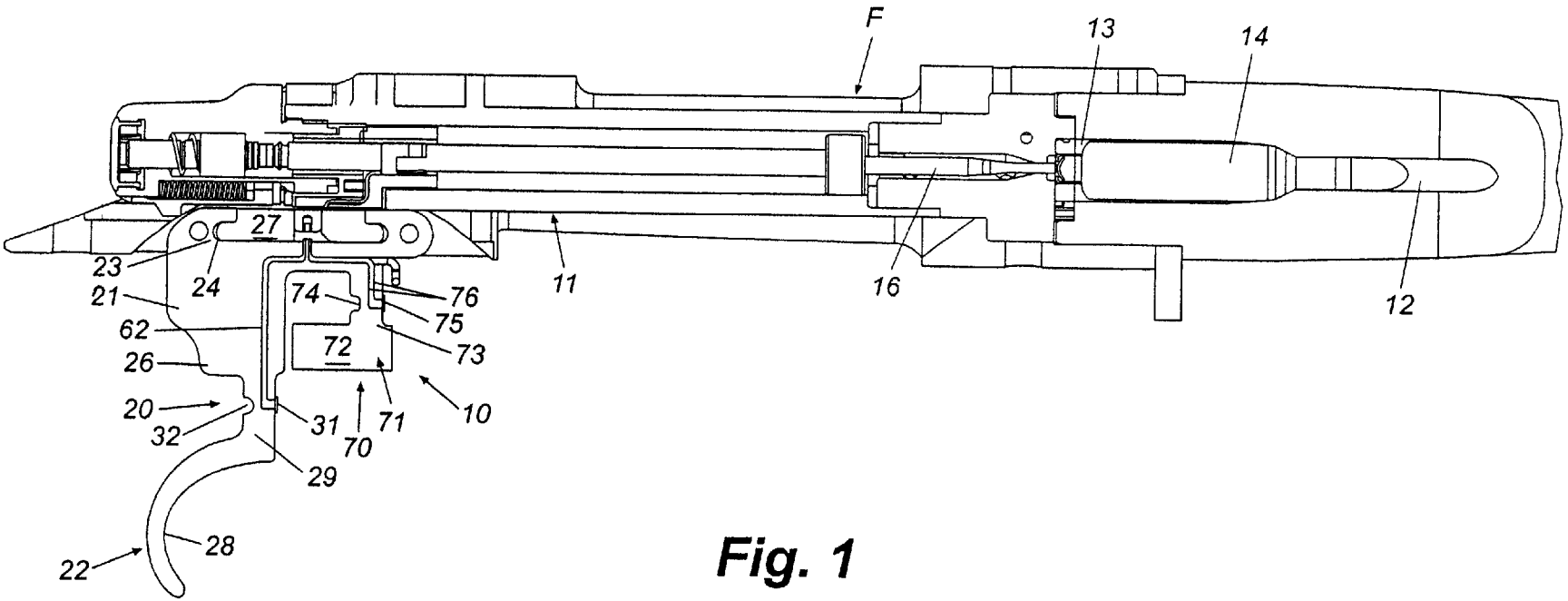
FIG. 1 illustrates a side elevational view taken in partial cross-section of an example firearm having a fire control assembly of the present invention mounted therein.

In general, as illustrated in FIG. 1, the firearm F, having the actuator assembly 10 of the present invention mounted thereto generally will include a receiver or frame 11 and a barrel 12 defining a chamber 13 in which a round of ammunition 14 typically is received. The round of ammunition 14 can be either a percussion primed ammunition or an electrically primed ammunition. A firing pin or probe 16 generally is mounted within and is movable along the receiver or frame 11 of the firearm F into contact with the round of ammunition to strike the round or apply an electric charge to the primer of the round in order to initiate firing of the round. The actuator assembly 10 generally is mounted adjacent or within the receiver or frame 11 of the firearm and typically includes a trigger assembly 20 for engagement by a user to initiate an operational sequence of the firearm/hand-operated device.

As shown in FIGS. 1–3C, the trigger assembly 20 of actuator assembly 10 typically is a substantially unitary member or structure, generally having a one-piece construction so as to require substantially no movement or near zero displacement thereof for actuation. The trigger assembly 20 generally includes a body portion 21 that is typically mounted to the receiver or frame of the firearm, and a trigger 22 that is generally formed with and projects from the body for engagement by the user. Various embodiments or designs of the trigger assembly 20 generally are illustrated in FIGS. 1–4, each generally showing a substantially unitary structure with the body 21 of each embodiment being formed in a variety of different designs or configurations, including substantially square, rectangular, cylindrical "S" and "U" or "C" shapes, or other designs as desired. Typically, the body and trigger are formed from a metal such as steel, although they can also be formed from other high-strength, substantially rigid, durable materials including composites and other metals such as titanium.

Figure 2:
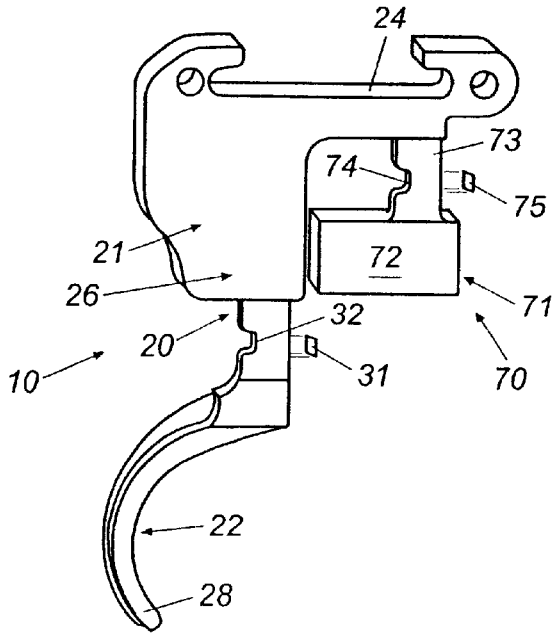
FIG. 2 is a perspective illustration of a first embodiment of the trigger assembly of the present invention.

In a first embodiment of the trigger assembly 20 as illustrated in FIGS. 1 and 2, the body portion 21 includes an upper end 23 having an upper cavity or recess 24 formed therein and which extends substantially along the length of the upper end of the body, and a lower end 26 from which the trigger 22 projects. An insulator 27 (FIG. 1), typically a block formed from a plastic or other insulative material, is received within the cavity 24 formed in the upper end of the body for insulating the trigger assembly 20 from the firing pin for use in systems firing electrically actuated primer ammunition, such as disclosed in U.S. Pat. No. 5,755,056. The trigger 22 of trigger assembly 20 generally is formed as a bow or curved section 28 projecting from the body, similar to a conventional firearm trigger. In a first embodiment of the trigger assembly shown in FIGS. 1 and 2, the trigger is connected to the body 21 by a trigger cantilever 29 or extension. The trigger 22 is adapted to be engaged by a user for initiating the operation of the firearm, or other hand-held or hand-operated device in which the actuator assembly 10 is being used, such as for firing the round of ammunition.

A first or trigger measuring device 31 generally is mounted adjacent the trigger 22 or trigger cantilever 29 in a position for detecting and measuring a force applied to the trigger by a user to initiate the operational sequence of the device. The trigger measuring device generally includes a strain gauge, load cell, transducer, force-sensor, force-sensing resister, conductive rubber element, piezo electric sensor, piezo-resistive film, or a similar type of sensing element or other detector capable of detecting the application of a force to or deflection of the trigger. In the embodiment illustrated in FIGS. 1 and 2, the trigger measuring device 31 generally is mounted along the cantilever or extension section 29 positioned between the trigger 22 and body 21 of the trigger assembly 20. Additional embodiments of the trigger assembly 20 showing various alternative designs or constructions of the body 21 of the trigger assembly with the trigger measuring device 31 mounted at various positions along the trigger assembly 20 are shown in FIGS. 3A–5. In addition, while the measuring devices disclosed in various embodiments of the invention are shown or described herein as substantially operating in tension, it will be understood by those skilled in the art that the measuring device(s) also can be located along the trigger assembly to a point in compression as contemplated by this invention.

Figure 3A:
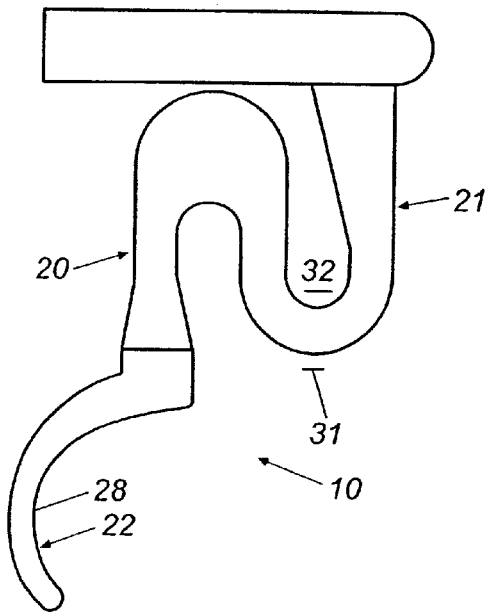
FIGS. 3A–3C are side elevational view illustrating different embodiments of the trigger assembly of the present invention.
Figure 3B:
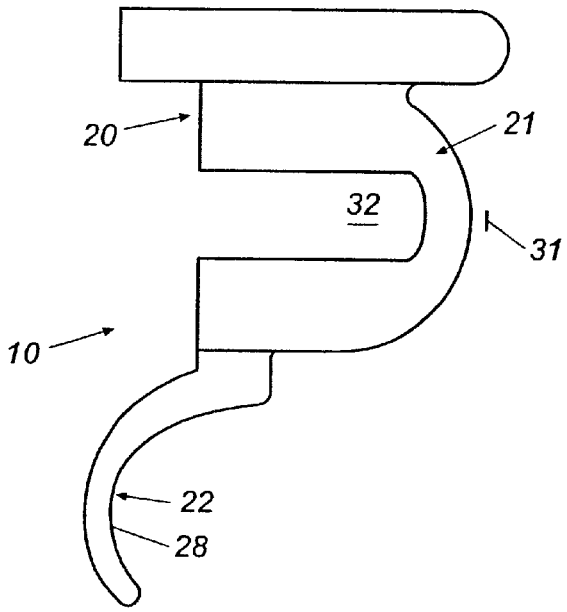
Figure 3C:
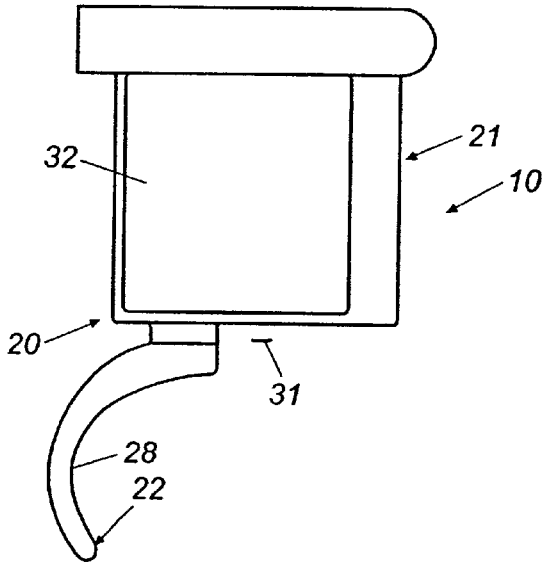

The trigger measuring device in operation detects the application of a force to the trigger and/or deflection of the trigger and in response generates a trigger signal so as to start or initiate the operational sequence of the device. A cavity, notch, bump or other sensitivity increasing feature 32 also can be formed in the cantilever 29, trigger 22, or body 21, or as illustrated in FIGS. 3A–3C wherein the body of the trigger assembly is formed in various different configurations or designs, such as a substantially "U" or "C" shaped, "S" shaped or substantially square with a cavity or opening formed therethrough to function as a sensitivity increasing feature for the body. As indicated in FIGS. 1–3C, the trigger measuring device 31 generally is mounted to the cantilever or body of the trigger assembly, generally at a location opposite the sensitivity increasing feature, i.e., a notch or cavity. For other features like bumps, the trigger measuring device often is located over the sensitivity increasing feature. As a result, when a force is applied to the trigger, the application of such a force is enhanced or increased in the region of the sensitivity increasing feature so that the sensitivity of the measuring device to detect the force being applied to the trigger is likewise increased, or enhanced to ensure that the application of the force to the trigger will be detected by the trigger measuring device.

Figure 4:
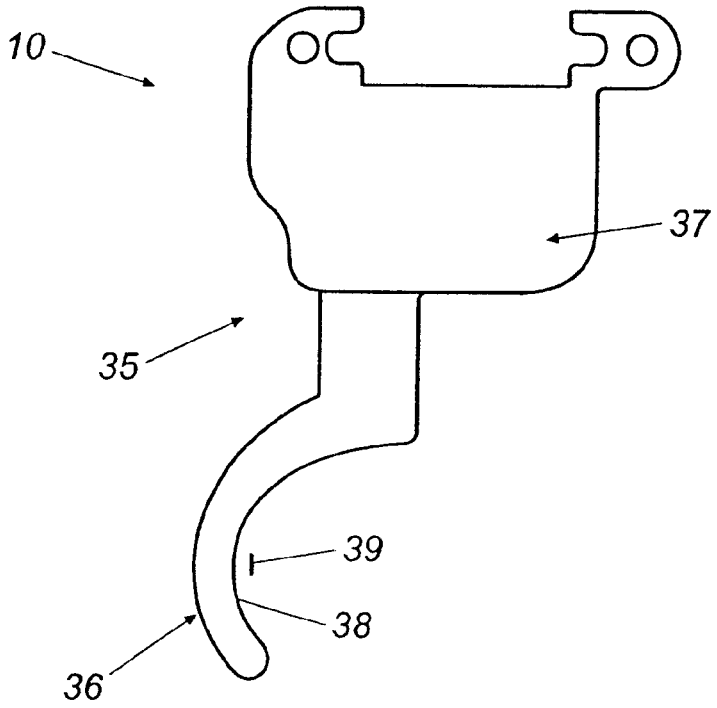
FIG. 4 is a side elevational view illustrating still a further embodiment of the present invention.

In still a further embodiment of the trigger assembly, indicated by 35 in FIG. 4, the trigger assembly 35 is formed in a substantially unitary or one-piece construction with a trigger 36 extending or projecting from a body portion 37. In this embodiment, the trigger is formed with a bow or curve 38, as in a conventional trigger, with a trigger measuring device 39 being mounted directly in the bow or curve 38 of the trigger 36, in the center thereof. The trigger measuring device generally is mounted approximately in the center of the bow, in an area of the trigger typically or most likely is engaged by the user when the user engages the trigger to fire the round of ammunition. The trigger measuring device thus is engaged and measures the force applied by the user and in response, generates a trigger signal to initiate the operational sequence of the device, i.e., firing the round of ammunition. In other applications, such as for hand-held devices such as a variable-speed drill, the trigger measuring device further can monitor the varying application of force to the trigger for controlling the speed of the drill or other device at varying levels.

Figure 5:
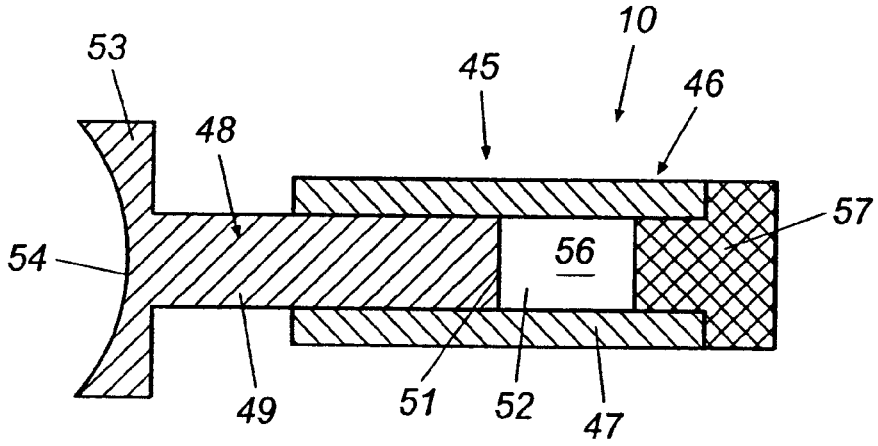
FIG. 5 is a side elevational view taken in partial cross-section of yet another embodiment of the present invention.

Still a further embodiment of the trigger assembly, indicated by 45, is illustrated in FIG. 5. In this embodiment, the trigger assembly 45 generally is formed as a cylinder 46 having a cylinder body 47, and a trigger or plunger 48 that is received within the cylinder body 47. The trigger or plunger typically includes a rod or substantially rigid member 49 having a first-end 51 received within a cavity or internal bore 52 of the cylinder body 47, and a second or trigger-end 53 that is spaced from the end of the body 47 and typically is formed with a bow 54 or curved structure similar in design to a conventional trigger. A substantially incompressible fluid 56 is generally received within the bore 52 of the body 47 behind the first-end 51 of the trigger or plunger 48. The incompressible fluid can typically include a hydraulic fluid or a similar incompressible medium that substantially prevents movement of the trigger or plunger further into the bore of the cylinder body. A trigger measuring device 57 generally is positioned at the end of the bore 52 of the cylinder body 47 opposite the first-end of the trigger or plunger, with the incompressible fluid 56 being contained between the trigger measuring device 57 and the end of the trigger 48. The trigger measuring device typically is a pressure-sensor or similar type of force-sensing element that detects of the application of a force to the trigger by a user as the trigger is urged against the incompressible fluid. Upon detection of the application of such force, the trigger measuring device accordingly generates a trigger signal to initiate the operational sequence of the device.

In each of the various embodiments of the trigger assembly illustrated in FIGS. 1–5, the trigger measuring device 31, 39 or 57 of each trigger assembly detects the application of a force to the trigger and in response generates a trigger signal that typically is communicated to a control system 60, generally indicated in FIGS. 6A–6E. The control system 60 processes the inputs from the trigger assembly and controls the initiation and operation of the device in which the actuator assembly 10 of the present invention is being used, i.e., initiates and fires a round of ammunition in a firearm or controls operations such as the operational speed of a hand-held tool such as a variable speed drill. The control system typically includes a controller 61, which is generally a microprocessor or microcontroller, discrete digital logic, discrete analog logic and/or custom integrated logic or a similar control system.

Figure 7:
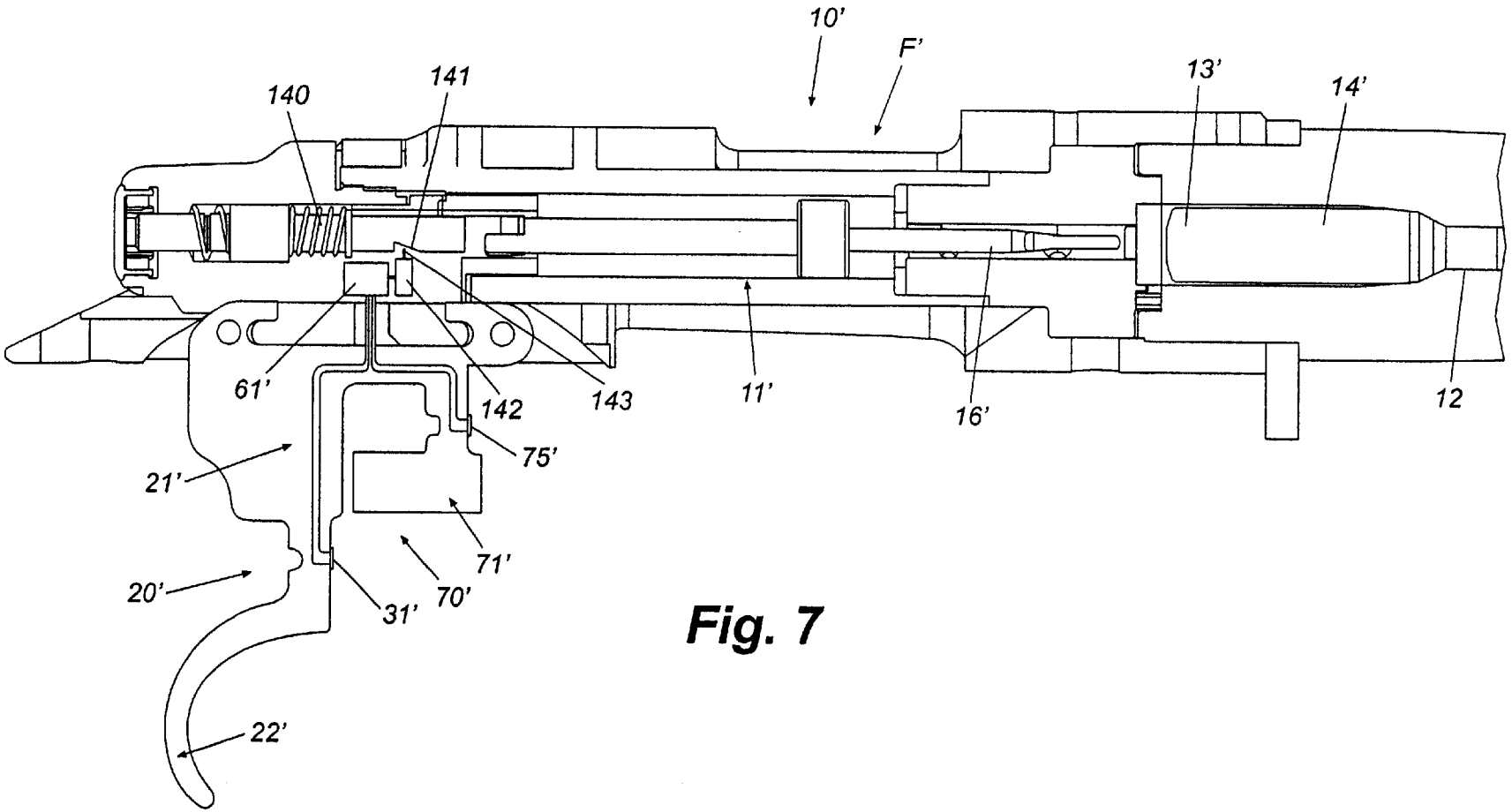
FIG. 7 is a side elevational view taken in partial cross-section of the fire control assembly of the present invention for use in a firearm for firing percussion actuated ammunition.

The control system further can be embodied in a separate controller or can be included as part of an overall control system such as the system controller of an electronic firearm that fires electrically actuated ammunition as disclosed in U.S. Pat. No. 5,755,056, the disclosure of which is incorporated herein by reference. The control system further can comprise software, firmware, microcode or other programmed code or logic that is included within the controller for such an electronic firearm or other hand-operated or hand-actuated device. In addition, as will be more fully discussed below, the control system can be a separate or dedicated processor or control system that controls the operation of an electromechanical system or application, such as for releasing a firing pin to fire percussion primed ammunition as illustrated in FIG. 7.

The controller 61 of control system 60 generally is programmed with pre-determined operating values or ranges of values for rates of change of the trigger signal and communicates with the trigger measuring device via a wire 62 (FIG. 1) or similar transmission mechanism. The control system 60 (FIGS. 6A–6E) further can include a comparator or series of comparators 63, a filter, such as a high pass or low pass filter, and a voltage reference 66. The voltage reference 66 typically is programmed with a pre-determined or pre-programmed value for a trigger voltage(s) required for initiating an operation of the device, and typically is a variable reference so as to include a range of pre-determined values. This reference value is generally communicated as a voltage reference signal 67 or a comparator 63 for comparison to a trigger signal from the trigger measuring device 31. As a result, if the trigger signal from the trigger measuring device of the trigger assembly falls significantly outside of this value or range of values from the voltage reference, the trigger signal can be blocked so as to prevent initiation of the operational sequence of the device. In addition, the variability of the voltage reference 66 further enables adjustment or setting of a desired trigger pull level, i.e., 3–10 pounds, that would be consistently required for initiating and/or controlling the operational sequence of the device. In addition, the actuator assembly 10 generally further includes a fixed or variable power source connected to and powering the operation of the actuator control system and measuring devices.

The actuator assembly 10 (FIG. 1) further typically includes a compensating system 70 for compensating for variances or errors in the trigger signal provided by the trigger measuring device and/or detection of the trigger signal exceeding a threshold limit required for initiating the operational sequence of the hand-held device. The compensating system can be separate from or can be included within the controller 61 of the overall actuator control system 60 of the actuator assembly 10 and further can include both mechanical and electrical components. Various embodiments of the compensating system and the actuator control system are illustrated in FIGS. 6A–6H.

Figure 6A:
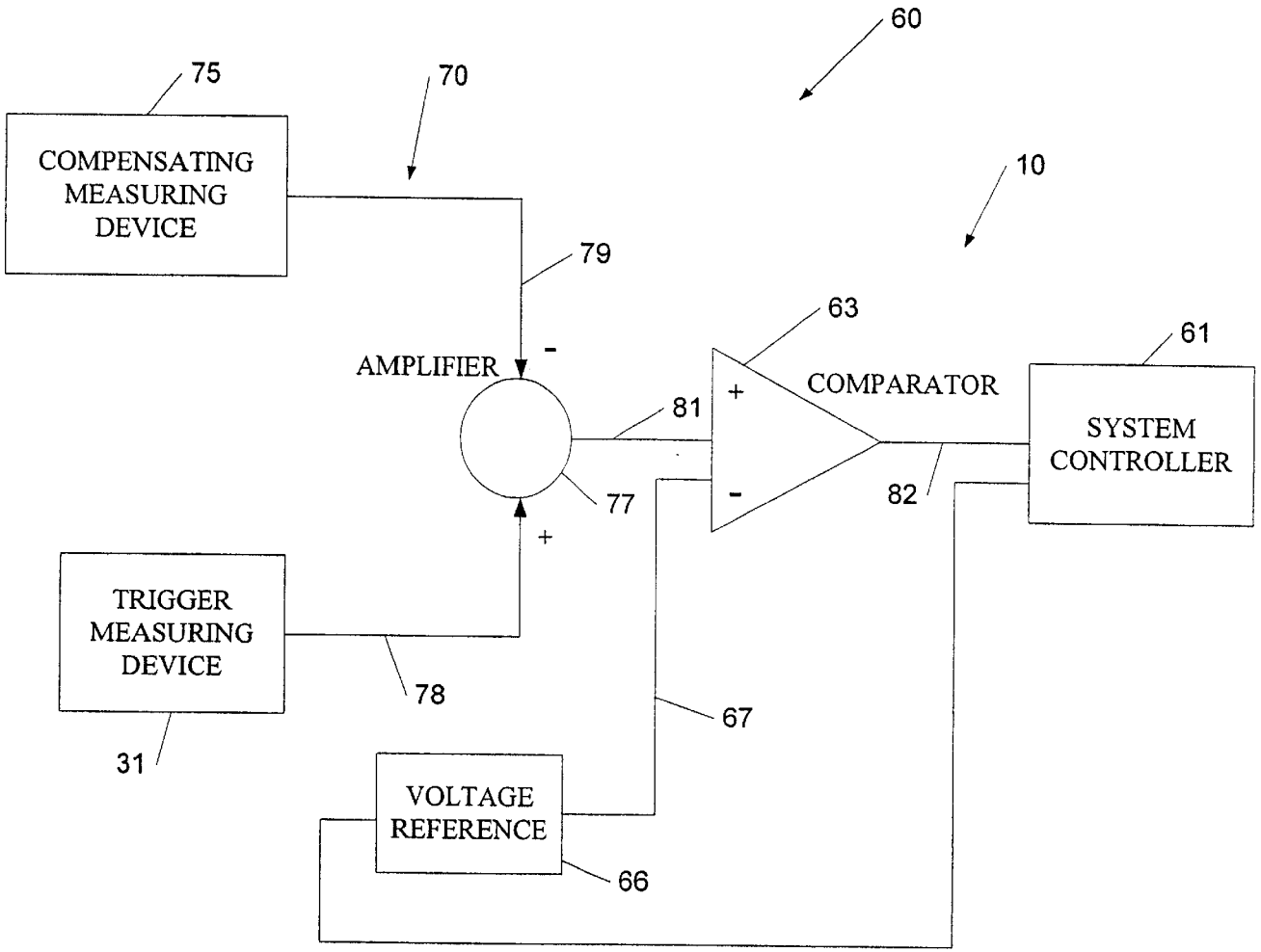
FIGS. 6A–6H are schematic illustrations of various embodiments of the fire control system of the present invention.

In a first embodiment illustrated in FIGS. 1, 2 and 6A, the compensating system 70 generally includes a compensating mass 71 that is formed with and projects from the body 21 of the trigger assembly 20 as part of the unitary structure or one-piece construction thereof The compensating mass generally is formed as a block 72 or other element having a mass effect substantially equivalent to the mass effect of the trigger 22, and generally is connected to the body via a compensating cantilever or extension section 73. A cavity, notch, bump or other sensitivity increasing feature 74 generally is formed along the compensating cantilever 73, as indicated in FIGS. 1 and 2, and a compensating or second measuring device 75 is further mounted to the compensating cantilever 73, typically positioned opposite the cavity or other sensitivity increasing feature 74, and communicates with the control system via a wire 76 or similar transmission mechanism. The compensating measuring device generally includes a strain gauge, load cell, transducer, force-sensor, force-sensing resister, conductive rubber element, piezoelectric sensor, piezo-resistant film or similar type of sensing element, such as used for the trigger measuring device, for detection and measurement of a force applied to the compensating mass.

If the hand-held device or system using the actuator assembly of the present invention is inadvertently jarred or receives a shock or other application of force, such as from the hand-operated device being dropped, as opposed to the application of force to the trigger alone (i.e., user squeezes the trigger for firing a round of ammunition), the application of such force further generally will tend to act on both the trigger and the compensating mass 71. The compensating measuring device 75 of the compensating system 70 accordingly will generate or will record and generate a compensating signal similar to that of the trigger signal generated by the trigger measuring device 31.

As illustrated in FIG. 6A, the compensating system 70 generally further includes an amplifier 77 that receives a trigger signal 78 and a compensating signal 79, from the trigger and compensating measuring devices 31 and 75, respectively. The amplifier generally combines and/or modifies the trigger and compensating signals 78 and 79, and in response, generates a composite signal 81 that typically is sent to the comparator 63 of the control system 60 for comparison with the reference voltage signal 67 from the voltage reference 66. The comparator in turn provides an output signal 82 to the controller 61 for processing by the controller to decide whether to initiate the operation of the device. The signals from the compensating and trigger measuring devices further can be combined by amplifier 77 so as to be substantially opposite in polarity to provide an additional feature of self-compensation for variations in the measurement devices themselves. The opposing signals can be used to cancel each other out so as to, for example, cancel any erroneously initiated trigger signals induced through jarring or dropping of the hand-operated device, or variations in operating or environmental temperature, or similar undesired events.

The amplifier 77 typically is a differential operational amplifier such as a precision instrumentation amplifier that generally produces high gains with very low output drift and noise. As indicated, the amplifier typically receives a positive and a negative input responding to the trigger and compensating signals 78 and 79, respectively. The negative input generally is subtracted from or otherwise combined with the positive input and the result multiplied by a predefined or user defined gain to generate a composite signal 81. An example amplifier that can be used in the present invention could include the model LTC 1250 and/or LTC 1167 manufactured by Linear Technology.

Figure 6B:
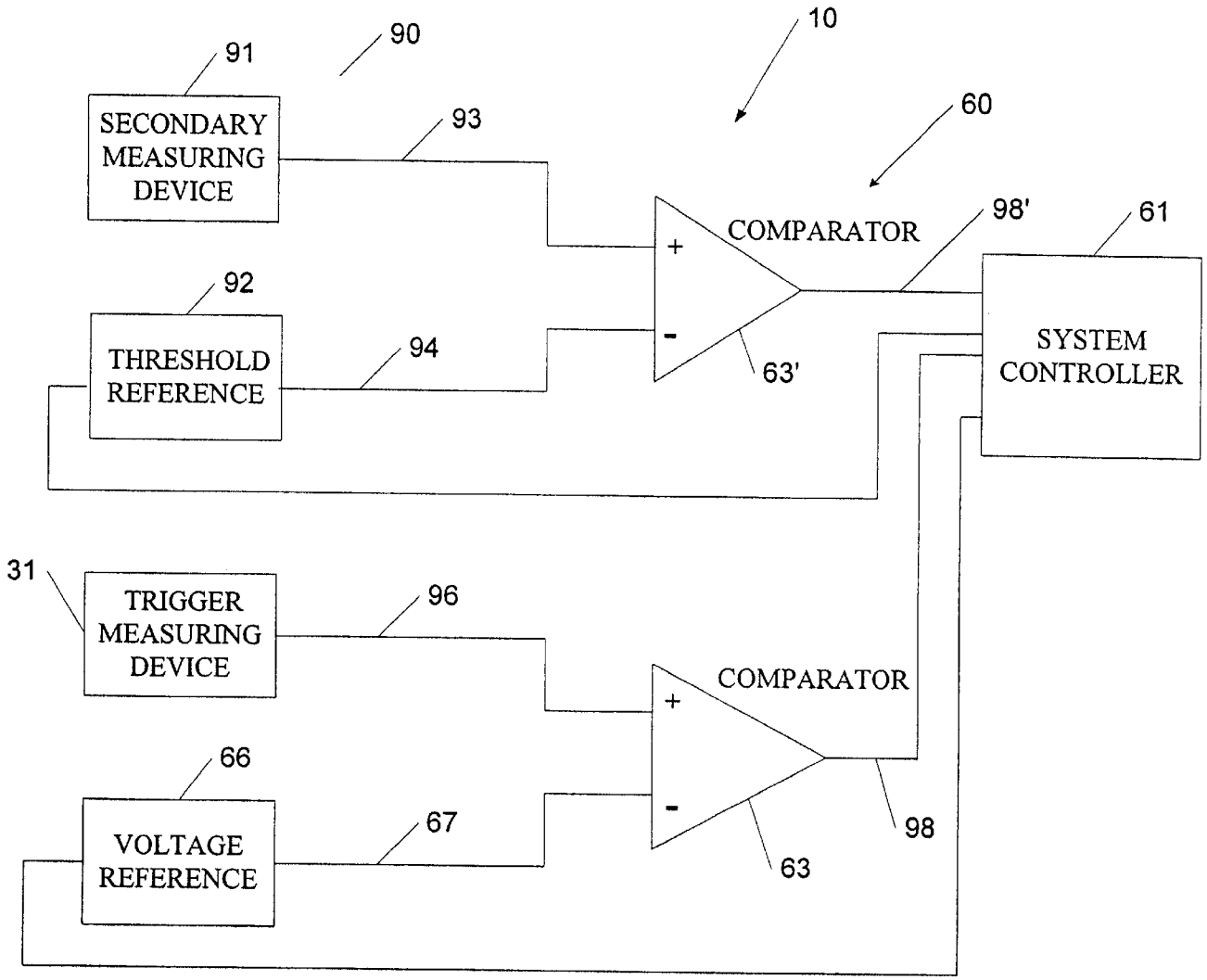

A second embodiment of the control system 60 for the actuator assembly 10 of the present invention with a compensating system 90 based upon threshold limit detection is shown in FIG. 6B. In this embodiment, the control system 60 generally includes a pair of comparators 63 and 63', as well as a voltage reference 66 which communicates with, and supplies a voltage reference signal 67 to comparator 63. Similarly, in this embodiment, the compensating system 90 of FIG. 6B, generally comprises a threshold limit detection mechanism that includes a secondary measuring device 91 that generally is mounted adjacent a compensating mass, such as mounted along a cantelever as shown in the trigger assembly 20 shown in FIGS. 1 and 2, although the secondary measuring device as shown in FIG. 6B further can be mounted at other positions along the body of the trigger assembly as will be understood by those skilled in the art. The secondary measuring device 91 generally is a strain gauge, load cell, transducer, conductive rubber, piezoelectric sensor, piezo-resistive film, force sensing resistor, or other force sensor or detector, similar to the trigger measuring device 31.

A threshold reference 92 is generally programmed with predetermined or desired threshold value required for disabling the operational sequence of the hand-operated device. The threshold reference 92, like the voltage reference 66, also can be a variable reference, enabling it to be programmed by the system controller with a range of values as desired for compensating for jarring events or thermal effects. In operation, the secondary measuring device 91 will send a compensating or secondary signal 93 upon detection of a force such as the hand-operated device being dropped or otherwise subjected to a jarring force, or as thermal expansion acts upon the secondary measuring device as the hand-operated device is subjected to changing environmental conditions. As shown in FIG. 6B, the compensating signal 93 is communicated to comparator 63' as is a threshold signal 94 provided by the threshold reference 92. The comparators 63' and 63 compare the threshold signal 94 with compensating signal 93 and a trigger signal 96 from the trigger measuring device 31 with the voltage reference signal 67, respectively, and, in response, each generate a comparator or output signal 98 and 98'.

These signals are communicated to the controller 61 of the control system. The controller, in response, will block or otherwise stop the initiation of the operational sequence of the hand-held device if the compensating signal from the secondary measuring device is greater than or equal to the threshold signal, resulting in a high or positive composite comparator signal 98', or the trigger signal fails to exceed the voltage reference level required for initiating operation, resulting in a null or negative composite signal 98. For example, in an electronic firearm firing electronically actuated ammunition, if the compensating signal exceeds the threshold reference signal and/or the trigger signal fails to exceed the voltage reference signal, the control system blocks the transmission of an electric firing charge or pulse through the firing pin so that the round of ammunition will not be fired.

Figure 6C:
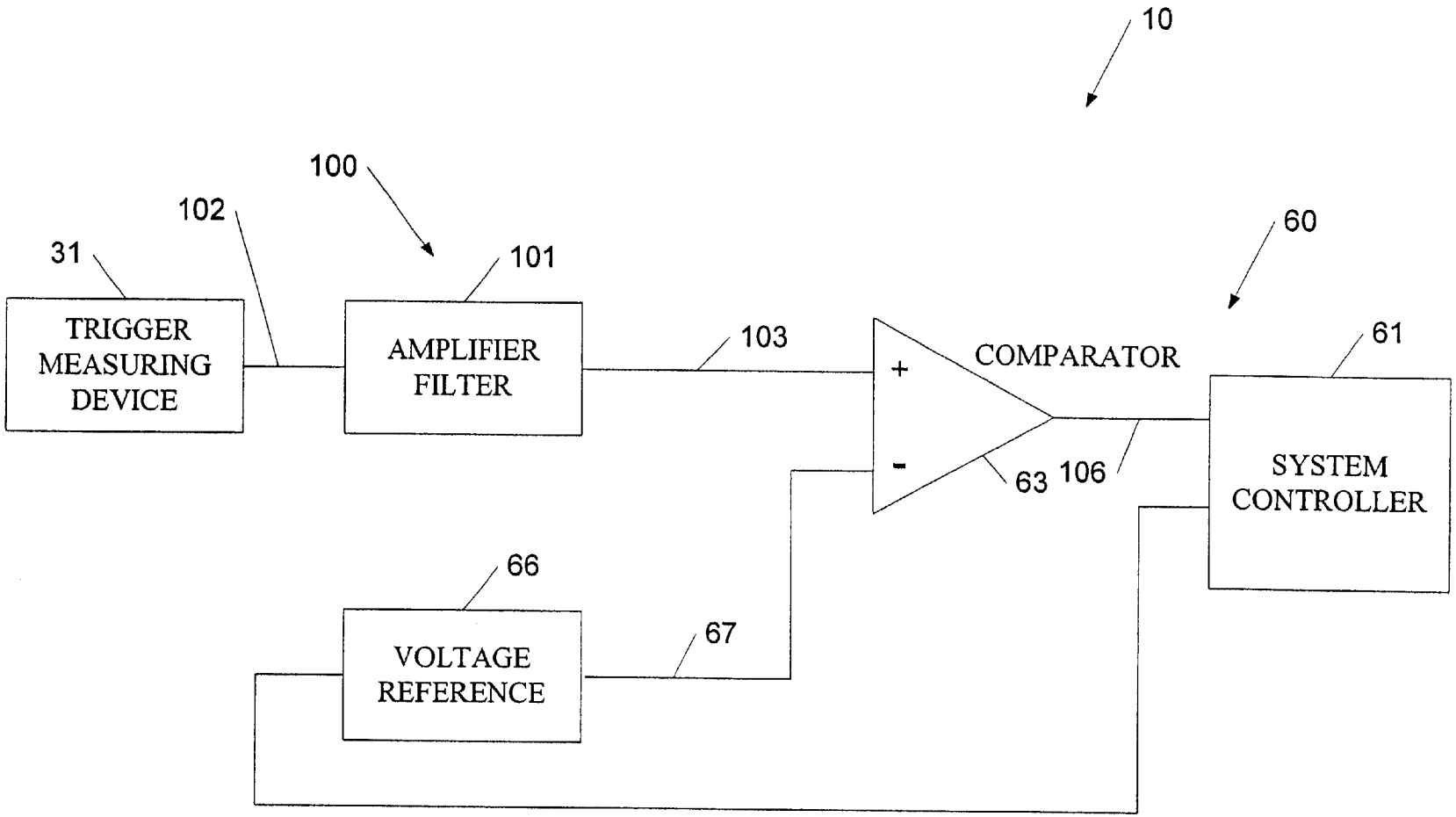

A further embodiment of a compensating system, indicated by 100, for the present invention is illustrated in FIG. 6C. In this embodiment, the compensating system 100 includes a filter-amplifier 101 that receives a trigger signal 102 from the trigger measuring device 31. The filter-amplifier 101 typically employs a differential operational amplifier configured to provide gain (amplification) of trigger signal 102 at specific input frequencies and to reject trigger signal content at frequencies outside a specified range. The filter-amplifier 101 will be recognized by those skilled in the art as providing a selection of topologies including low pass, band pass, high pass, and band reject frequency functions. It further will be recognized that for trigger signals 102 which do not require amplification, the filter-amplifier 101 potentially can be reduced to a completely passive design consisting typically of only resistors, capacitors, and inductors. Further, those skilled in digital signal processing design will realize that the filter-amplifier 101 function may be performed digitally using Z transform processing techniques.

The compensating system 100 of FIG. 6C generally focuses on detection and monitoring of the rates of change of the trigger signal 102 for control of the initiation or actuation of the operation of the hand-operated device. For example, a temperature induced trigger signal, i.e. thermal expansion of the trigger due to extreme heat or cold, generally occurs at a rate of change that is much slower than the corresponding trigger signal that would be produced by the user squeezing the trigger. Similarly, application of a jarring force, such as if the hand-operated device is dropped, generally would result in a trigger signal that has a rate of change much greater or faster than the corresponding trigger signal resulting from a user squeezing the trigger.

In this example the filter-amplifier 101 would be configured to perform a band pass filter function wherein slow moving (low frequency) thermal effects and fast moving (high frequency) jarring force effects are eliminated from processed filter signal 103. The filter signal is then sent to a comparator 63 of the control system 60. The comparator compares this resultant filter signal 103 to the voltage reference signal 67 provided by voltage reference 66 and in turn generates a comparator output or composite signal 106 that is communicated to the controller 61 of the control system. The controller 61 monitors this output signal 106 and blocks the actuation or initiation of the operational sequence of the hand-operated device until filter signal 103 exceeds the threshold voltage reference signal 67.

Figure 6D:
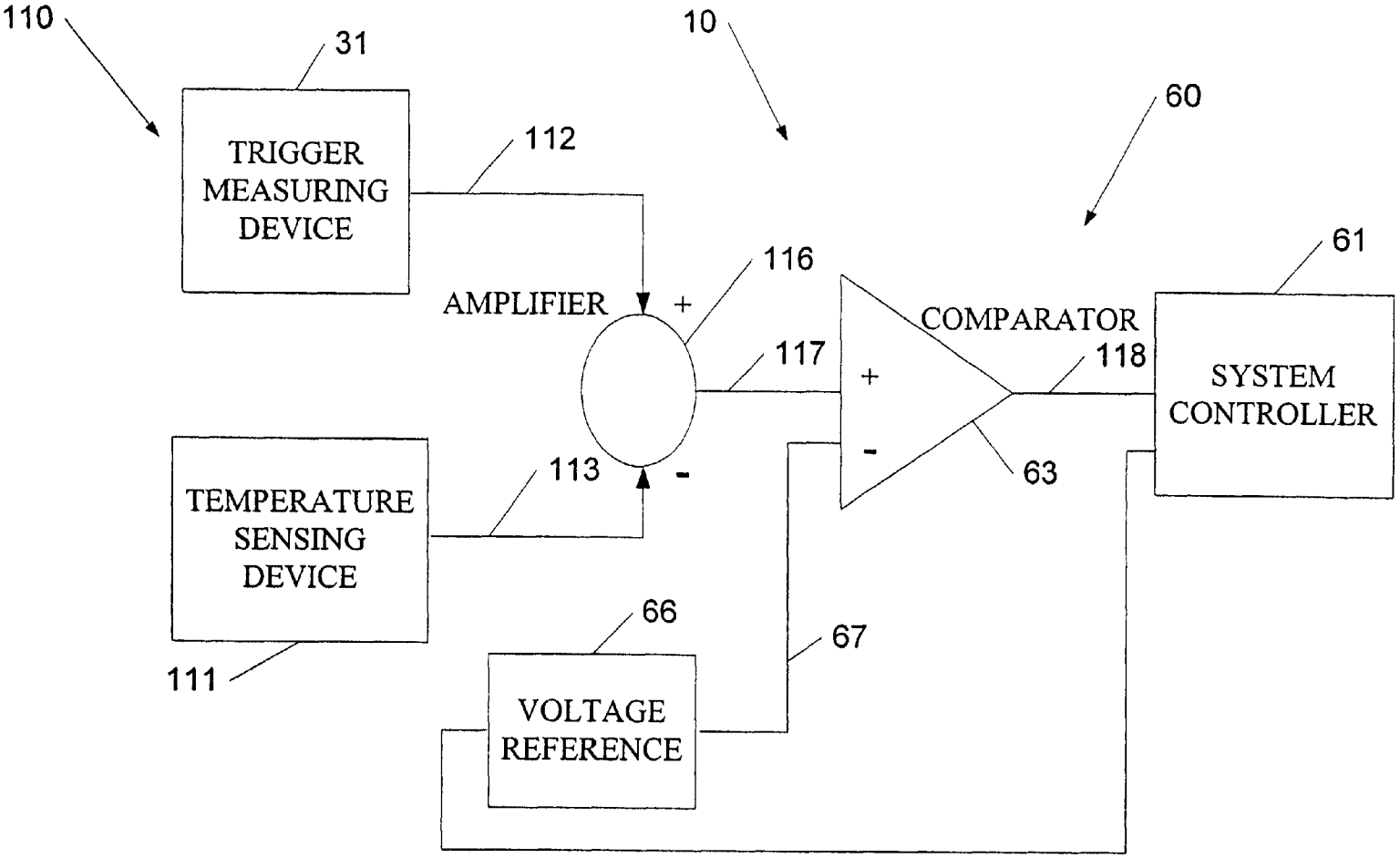

A further embodiment of a compensating system, indicated by 110, for the actuator assembly of the present invention is illustrated in FIG. 6D. The compensating system 110 of FIG. 6D includes a temperature sensor 111 that measures the temperature of the trigger measuring device 31. The temperature sensor 111 itself generates a corresponding temperature induced trigger signal 113 so that the thermal output of the trigger measuring device as a function of temperature can be compensated by amplifier 116 such that the resultant composite signal 117 is unaffected by variations in environmental temperature. The trigger signal 112 from the trigger measuring device 31 is fed as one input to an amplifier 116, typically an operational amplifier such as a LM324, at the same time that the corresponding temperature induced trigger signal 113 is also communicated to the amplifier. The two signals are received within the amplifier with the temperature induced trigger signal 113 generally being subtracted from the trigger signal 112 in order to generate an amplified composite signal 117 that takes into account variances resulting from changes in temperature acting on the trigger measuring device 31. The amplified signal 117 is then fed to comparator 63, which compares the amplified signal to a voltage reference signal 67 from the voltage reference 66 and generates a composite or output signal 118 indicative of the logical difference between the amplified and voltage reference signals. If the composite signal 117 exceeds the voltage reference signal 67, the control system allows the operational sequence of the hand-held device to proceed.

Figure 6E:
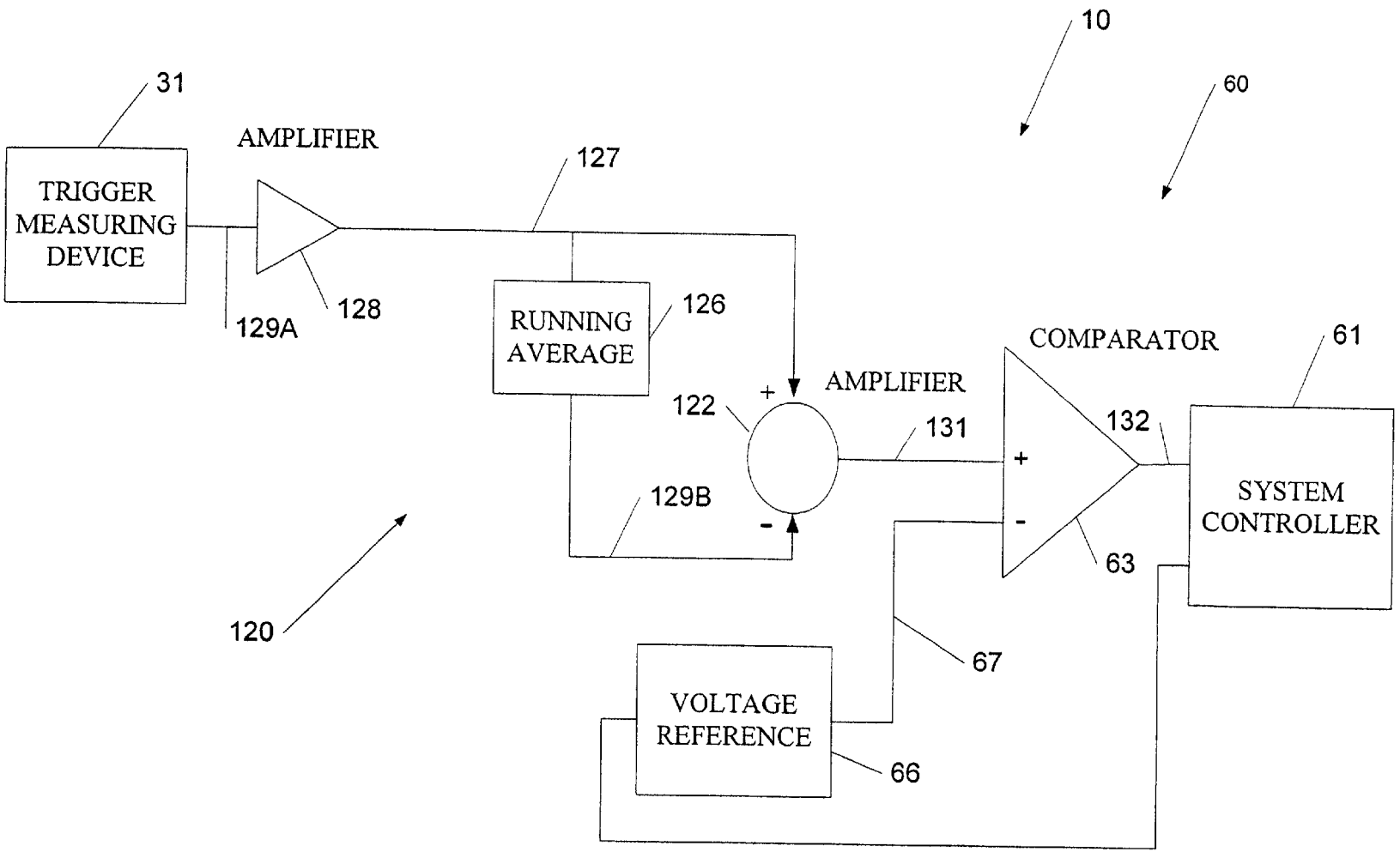

Still a further embodiment of a compensating system, indicated by 120, for the present invention is illustrated in FIG. 6E. The compensating system 120 of FIG. 6E is primarily directed to correcting erroneous trigger or drift signals that occur below a predetermined or desired rate of change necessary for initiating operation of the hand-operated device. In this system, correction of error signals generally is accomplished by modifying an amplified signal from the trigger measuring device 31 over time as the trigger signal is shifted or changes. The compensating system 120 generally includes a series of amplifiers 122 and 128, typically differential operational amplifiers. This embodiment further includes a mechanism 126 for maintaining a continuous running average of the instantaneous amplified signal 127 from the trigger measuring device. The running average mechanism 126 typically is a low pass filter but may also be programmed with and thus performed as a function of the controller 61, or can be embodied digitally such that the instantaneous amplified signal 127 is sampled digitally and the running average is maintained by digital signal processing techniques.

As indicated in FIG. 6E, the trigger measuring device 31 generates a trigger signal 129A on detection of an event such as a user squeezing the trigger, a jarring event or due to variations in environmental conditions. This signal 129A is typically amplified by amplifier 128 producing amplified signal 127. The instantaneous amplified trigger signal 127 is monitored over time by the running average mechanism 126 to produce a running average signal 129B which is fed to amplifier 122 along the instantaneous amplified trigger signal 127. The amplifier 122 subtracts the running average signal 129B from the instantaneous amplified trigger signal 127 and produces a composite signal 131 which is an effective analog compensated signal. Composite signal 131 is compared to voltage reference signal 67 and signals the system controller in a manner consistent with the previous embodiments.

The time period over which the running average will be generated or calculated and used to modify the instantaneous amplified trigger signal generally will be a time believed or selected to be much longer than the longest anticipated trigger pull. For example, a DSP based system might establish the drift or running average time for the trigger signal to be set at 20–30 seconds such that if the composite signal has not exceeded the voltage reference signal during such time, which would result in initiation of the operational sequence, i.e., firing of a firearm, the running average of the instantaneous amplified trigger signal will produce an updated running average signal to be used during the next 20–30 second interval. In the case of an analog low pass design, the running average signal would be continuously updating with a time constant that is typically in excess of 20–30 seconds.

An additional enhancement to the embodiments disclosed in FIGS. 6A–6E includes neglecting erroneous trigger signals that occur above a desired rate of change for initiating operation of the hand-operated device. In such a system, correction of error signals generally is accomplished by neglecting the amplified trigger signal until the signal exceeds a threshold and continues to exceed the threshold for a predetermined amount of time. As the trigger measuring device 31 generates a trigger signal on detection of an event such as a user squeezing the trigger, a jarring event, or due to variations in environmental conditions, the signal is typically amplified and compared to a voltage reference in a manner consistent with the previous embodiments. The signal generated by the comparator is then compared to a time reference specified in the system controller. The minimum time that the amplified signal is required to exceed the voltage reference is set to be greater than the longest anticipated jar events and less than the shortest anticipated trigger pull. By setting the minimum time at such a level, an erroneous trigger signal caused by a jarring event will be neglected. Typical jarring events have duration of 10 or less milliseconds. A trigger pull event typically takes seconds but have been observed being as small as 200 milliseconds. Typically, the minimum threshold time would be set to 40–50 milliseconds. Thus, any amplified trigger signal that does not reach the reference voltage and stay above the reference voltage for at least the minimum time of 40–50 milliseconds would be neglected.

Figure 6F:
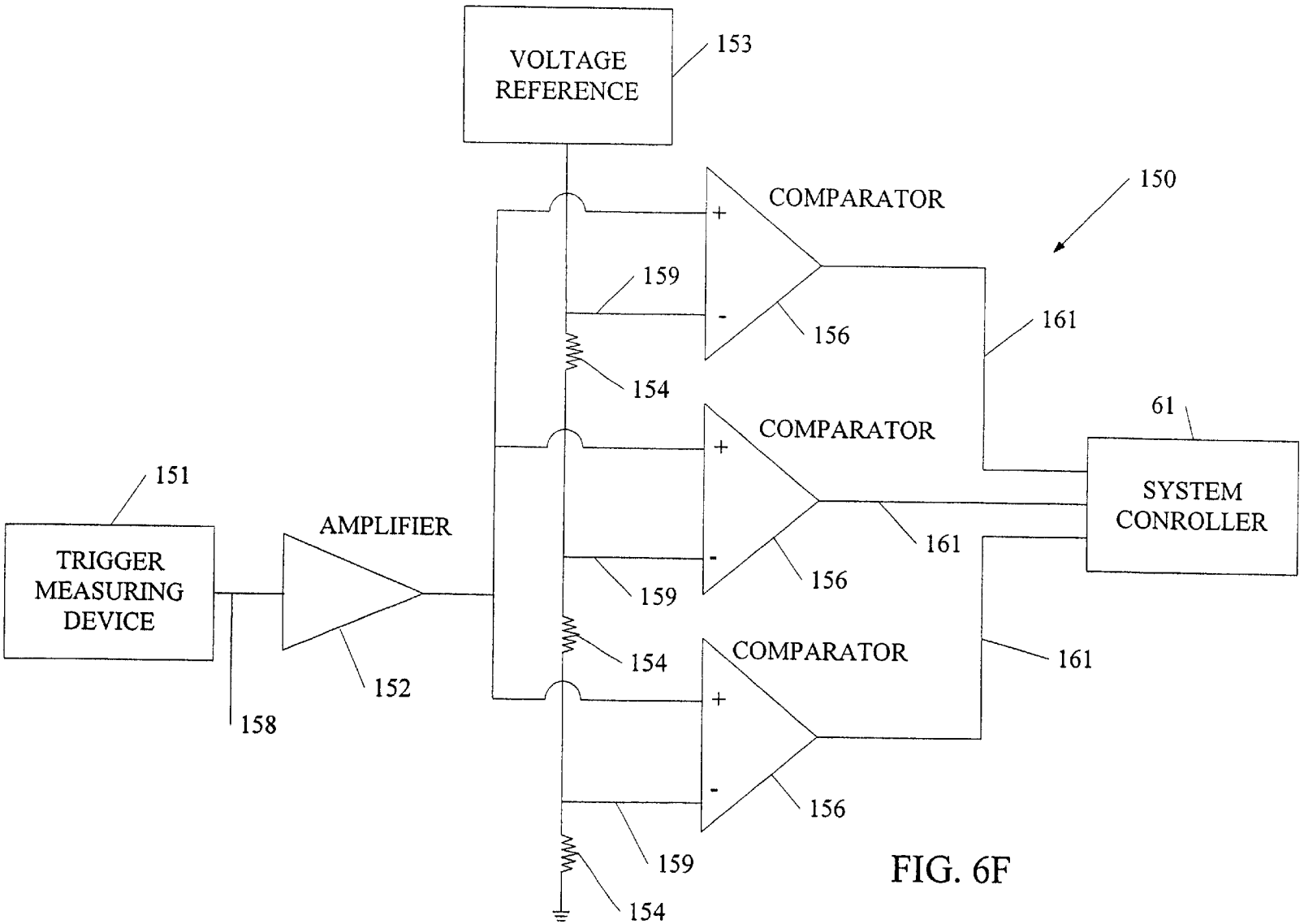

Yet another embodiment of the control system 150, shown in FIG. 6F, is directed to situations where the action to be taken is not completely binary in nature. An example of this would be the desire to run an electric motor at a multitude of different speeds depending on how much force is applied to the trigger member. The control system generally includes a trigger measuring device 151, an amplifier 152, a voltage reference 153, a plurality of resistors 154, a plurality of comparators 156, and a system controller 61. As indicated in FIG. 6F, the trigger measuring device 151 generates a trigger signal 158 as a function of a user squeezing the trigger. The signal is typically amplified at amplifier 152 and is then delivered to one input of each of the plurality of comparators 156. The voltage reference 153 and the plurality of resistors 154 produce a plurality of voltage references 159 to the comparators 156 for generation of composite or comparator output signals 161. Each of the comparator output signals 161 is sent to the system controller 61 so the system controller can determine the degree of force applied to the trigger member and initiate an appropriate operational sequence. It will be understood by those skilled in the art that varying degrees of resolution are possible based on the number of comparators employed.

Figure 6G:
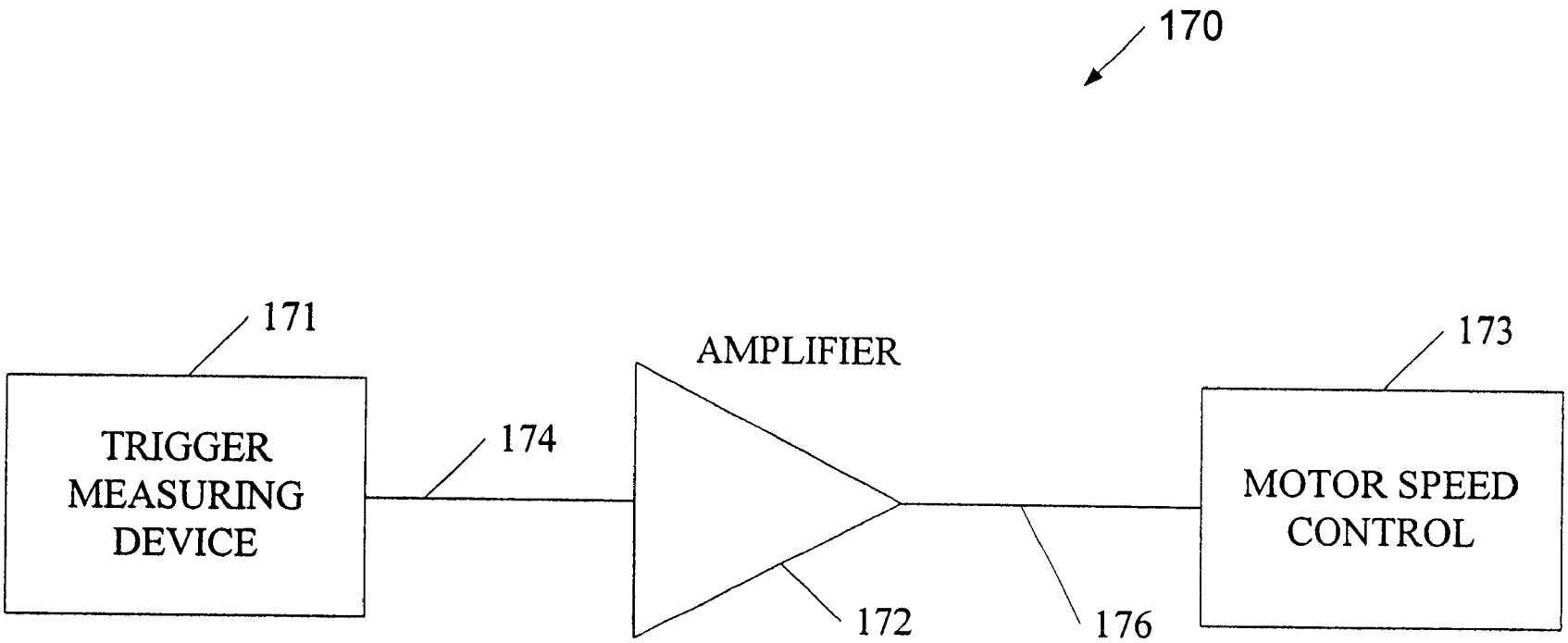

FIG. 6G illustrates another embodiment of the control system 170, which has a response that is capable of being a continuous function of the force applied to the trigger element. A variable speed drill is an example of where such a control system might be implemented, as typically drill motor speed changes as a function of the force applied to the trigger member of the drill. The control system 170 generally includes a trigger measuring device 171, an amplifier 172, and a motor speed control 173. As indicated in FIG. 6G, the trigger measuring device 171 generates a trigger signal 174 as a function of a user squeezing the trigger, which is fed to amplifier 172 to produce an amplified signal 176. The amplified signal 176 is then delivered to the motor speed control to direct motor speed. Depending on the type of motor being controlled, the motor speed control 173 can include a variable speed drive or a variable voltage supply or control, or can be simply a variable speed motor that is directly powered, and thus controlled, by the signals from the trigger measuring device. In the case of a variable speed drill, the speed of the motor generally is proportional to the amplified signal.

Figure 6H:
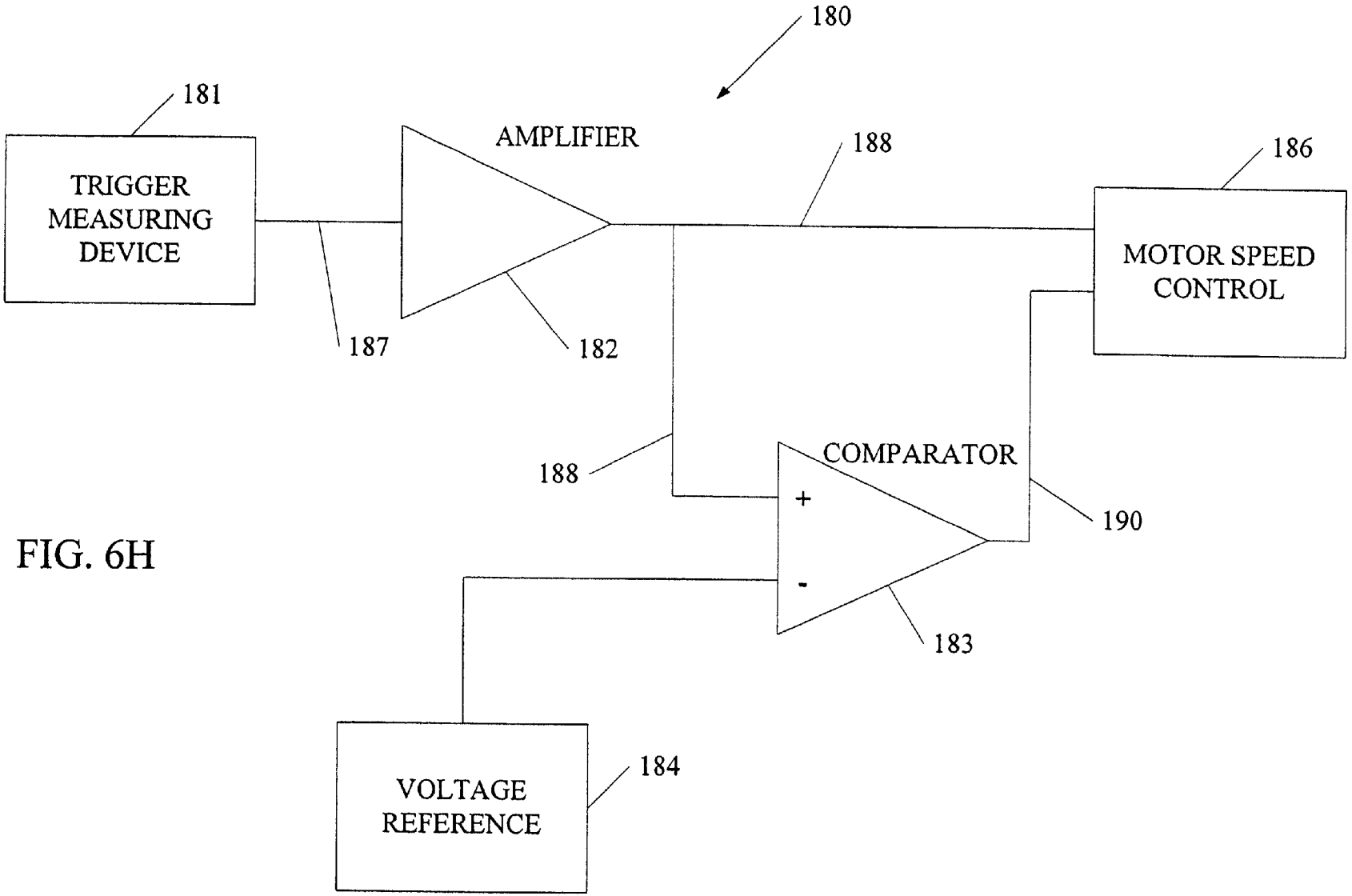

Still a further embodiment of the control system 180 is shown in FIG. 6H, and is directed to a system having a response that is capable of being a continuous function of the force applied to the trigger once some threshold level of force is reached. The control system 180 generally includes a trigger measuring device 181, an amplifier 182, a comparator 183, a voltage reference 184 and a motor speed control 186. As indicated in FIG. 6H, the trigger measuring device 181 generates a trigger signal 187 as a function of a user squeezing the trigger, which is amplified by amplifier 182 to produce an amplified signal 188. The amplified signal 188 is sent to the motor speed control and the comparator. The comparator 183 compares the amplified signal 188 to the reference signal 189 from the voltage reference 184 and generates a comparator output or composite signal 190. The motor speed control 186 will not allow any action to take place until the comparator 183 signals that the amplified signal has met the predetermined threshold. Once the threshold is met, the motor speed control causes the motor to respond as a continuous function of the amplified signal 188.

In the operation of the actuator assembly 10 of the present invention, shown in FIG. 1 as being used in a firearm "F" for purposes of illustration, as a user applies a force to the trigger 22 or if the device is subjected to another, erroneous force event such as a drop or temperature change, a signal is sent from the trigger measuring device 31 upon detection of such application of force. As indicated in FIGS. 6A–6E, this trigger signal can be modified with or by a compensating signal generated by a compensating system upon the occurrence of an erroneous force event such as the dropping or jarring of the firearm or the effect of thermal conditions on the trigger measuring device or firearm. The trigger signal generally is communicated to a comparator for the actuator assembly control system 60, which compares the trigger signal to a voltage reference signal. If the trigger signal exceeds the predetermined voltage reference or range of voltage reference values, the control system allows the initiation or actuation of the operational sequence for the firearm to occur for firing a round of ammunition 14 (FIG. 1).

For example, as illustrated in FIG. 1, for an electronic firearm firing electrically primed or actuated ammunition, upon receipt of a trigger signal in excess of the voltage reference value or range of values, the system controller of the actuator assembly of the present invention will communicate a firing signal to the system controller of the electronic firearm such as is disclosed in U.S. Pat. No. 5,755,056. The controller, in turn, will direct a firing pulse voltage or charge through an electrically conductive firing pin or probe to the electrically actuated primer of the round of ammunition cause ignition and thus firing of the round of ammunition. If however, the compensating signal generated by the compensating system exceeds the trigger signal or, as used to modify the trigger signal or voltage reference signal, causes the trigger signal to fall below the desired or modified voltage reference signal, the system controller will recognize this is an erroneous or false firing condition or event and will block the initiation of the operational sequence of the firearm to prevent the inadvertent discharge of the firearm resulting from a drop or changing thermal or environmental conditions.

In addition, as illustrated in FIG. 7, the actuator assembly 10' of the present invention also can be used in conventional firearm F' used for firing percussion primed ammunition 14'. In such firearms, the firing pin 16' generally is biased toward the round of ammunition 14' by a spring 140 and includes a notch 141 along its length. A solenoid 142, switch or other electromechanically actuated safety or engagement mechanism can be mounted within the frame or receiver 11' of the firearm, with the solenoid typically having an extensible pin or rod 143 that engages the notch 141 formed in the firing pin 16'. The engagement of the notch of the firing pin by the solenoid pin holds the firing pin in a non-fire condition or state to prevent the firing pin from being moved forward by its spring so as to strike and thus initiate the percussion primer of the round of ammunition to initiate the firing thereof. When the controller 61' of the actuator assembly control system detects a firing signal indicative of the trigger being actuated by a true trigger event, i.e., the user squeezes the trigger to fire the round of ammunition, the controller will signal the solenoid to release or retract its pin 143. As the pin releases from the firing pin, the firing pin is urged forwardly by the spring 140 against the percussion primer to set off or actuate the primer to fire the round of ammunition. The pin of the solenoid or other electromechanically actuated engagement mechanism thus acts in similar fashion to a sear in a conventional firearm for releasing the firing pin to strike and fire a round of ammunition.

The substantially unitary construction of the actuator assembly the present invention is designed to provide substantially zero or near-zero displacement trigger and the present invention can further enable the setting of a trigger pull or the amount of force required to be applied to the trigger at a desired, substantially set level that will remain substantially consistent over the life of the firearm. In addition, the system enables erroneous firing events such as a drop or the effects of thermal or environmental variations on the trigger assembly would be recognized and compensated to prevent the inadvertent or unintended discharge of a firearm. Further, the trigger signal generated by the actuator assembly can be monitored such that variations in the application of force to the trigger can be used for controlling a variety of hand-operated or hand actuated devices such as a variable speed drill, saw or other tool, at varying rates or speeds as desired.

It will be understood by those skilled in the art that while the present invention has been described above with reference to preferred embodiments, various modifications, additions, and changes can be made to the present invention without departing from the spirit and scope of this invention.

What is claimed is:

1. A method of firing a round of ammunition comprising:

applying a force to a trigger;

detecting the application of force to the trigger and generating a trigger signal;

monitoring a magnitude of the trigger signal and compensating for a rate of change of the trigger signal outside of a predetermined threshold range; and if the trigger signal is of a sufficient magnitude and within the predetermined threshold range, initiating an operational sequence to fire the round of ammunition.

2. The method of claim 1 and further comprising supplying a firing charge through a conductive firing probe to an electrically initiated primer charge in response to a firing signal to initiate explosion of the primer charge.

3. The method of claim 1 and further comprising the step of releasing a firing pin in response to a firing signal to enable the firing pin to be moved into engagement with and initiate firing of a percussion primer charge.

4. The method of claim 1 and wherein compensating for the rate of change comprises filtering out a trigger signal that changes too fast or too slow.

5. A method of initiating the firing of a round of ammunition in a firearm, comprising:

sensing an application of force to a trigger of the firearm;

generating a trigger signal in response to the application of force to the trigger;

monitoring the trigger signal and compensating for false or inadvertent trigger signals and generating an output signal; and initiating a firing signal if the output signal exceeds a predetermined threshold.

6. The method of claim 5 and further comprising supplying a firing charge through a conductive firing probe to an electrically initiated primer charge in response to the firing signal to initiate explosion of the primer charge.

7. The method of claim 5 and further comprising the step of releasing a firing pin in response to the firing signal to enable the firing pin to be moved into engagement with an initiate firing of a percussion primer charge.

8. The method of claim 5 and further comprising compensating for effects of temperature on the trigger.

9. The method of claim 5 and wherein compensating for false or inadvertent trigger signals comprises generating a compensating signal.

10. A method of controlling a hand operated device comprising:

applying a force to a trigger;

detecting the application of force to the trigger and generating a trigger signal;

monitoring a magnitude of the trigger signal;

compensating for an inadvertent trigger signal and generating an output signal; and if the output signal is of sufficient magnitude, initiating an operational sequence appropriate for the hand-operated device.

11. The method of claim 10 and wherein compensating for an inadvertent trigger signal comprises generating a compensating signal in response to an inadvertent trigger signal.

12. The method of claim 10 and wherein compensating for an inadvertent trigger signal comprises monitoring a rate of change of the trigger signal and compensating for a rate of change of the trigger signal that is outside a predetermined range.

13. The method of claim 12 and compensating for a rate of change comprises filtering the trigger signal and rejecting a trigger signal that falls outside a predetermined operating range of the rate of change of the trigger signal.

14. The method of claim 10 and wherein compensating for an inadvertent trigger signal comprises filtering the trigger signal and rejecting a signal that falls outside a predetermined operating range of the rate of change of the trigger signal.

15. The method of claim 10 and further including amplifying the trigger signal.

* * * * *